US007806662B2

(12) United States Patent
Gekht et al.

(10) Patent No.: US 7,806,662 B2
(45) Date of Patent: Oct. 5, 2010

(54) BLADE RETENTION SYSTEM FOR USE IN A GAS TURBINE ENGINE

(75) Inventors: Eugene Gekht, Brossard (CA); Franco Di Paola, Montréal (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 671 days.

(21) Appl. No.: 11/734,436

(22) Filed: Apr. 12, 2007

(65) Prior Publication Data

US 2008/0253895 A1 Oct. 16, 2008

(51) Int. Cl.
*F01D 5/32* (2006.01)

(52) U.S. Cl. ..... 416/221

(58) Field of Classification Search ..... 416/221, 416/220 R, 248

See application file for complete search history.

(56) References Cited

U.S. PATENT DOCUMENTS

| | | | | |
|---|---|---|---|---|
| 2,761,648 | A | 9/1956 | Purvis | |
| 2,786,648 | A | 3/1957 | Ledwith | |
| 2,828,942 | A | 4/1958 | McCullough et al. | |
| 2,847,187 | A | 8/1958 | Murphy | |
| 2,928,651 | A | 3/1960 | Turnbull | |
| 2,971,744 | A * | 2/1961 | Szydlowski | 416/221 |
| 3,076,634 | A * | 2/1963 | Boyle et al. | 416/221 |
| 3,077,811 | A | 2/1963 | Moore | |
| 3,248,081 | A | 4/1966 | Bobo et al. | |
| 3,598,503 | A | 8/1971 | Muller | |
| 3,700,354 | A * | 10/1972 | Memery | 416/221 |
| 4,326,835 | A | 4/1982 | Wertz | |
| 4,781,534 | A * | 11/1988 | Ferleger | 416/221 |
| 5,411,369 | A | 5/1995 | Bouchard | |
| 5,431,543 | A | 7/1995 | Brown et al. | |
| 5,518,369 | A | 5/1996 | Modafferi | |
| 5,984,639 | A | 11/1999 | Gekht et al. | |
| 6,109,877 | A | 8/2000 | Gekht et al. | |
| 6,533,550 | B1 | 3/2003 | Mills | |
| 6,837,686 | B2 * | 1/2005 | Di Paola et al. | 416/220 R |

FOREIGN PATENT DOCUMENTS

| | | | |
|---|---|---|---|
| JP | 05209536 A * | 8/1993 | |

* cited by examiner

*Primary Examiner*—Richard Edgar
(74) *Attorney, Agent, or Firm*—Ogilvy Renault LLP

(57) ABSTRACT

The blade retention system comprises an annular sealing plate and a plurality of spaced-apart blade retention tabs having opposite first and second ends and a radially-orientated corrugated profile. The first ends of the tabs are connected to a first side face of the annular sealing plate. Each tab is configured and disposed to be inserted through a bottom portion of a respective one of the blade retention slots when the first side face of the sealing plate is positioned against one of the side faces of the rotor disc and covers an end side of the blade retention slots. The second end of each tab extends beyond the other of the side faces of the rotor disc and is bent to secure the annular sealing plate with reference to the rotor disc.

14 Claims, 11 Drawing Sheets

BLADE RETENTION SYSTEM FOR USE IN A GAS TURBINE ENGINE

TECHNICAL FIELD

The field of the invention generally relates to a blade retention system and a method of retaining blades in a gas turbine engine.

BACKGROUND OF THE ART

Most turbine rotor discs and compressor rotor discs include blades that can be removably mounted using blade retention slots. These blade retention slots are provided at the periphery of the rotor discs to hold the roots of these blades using an interlocking engagement. In use, the high rotational speeds of the rotor discs require that the blades be securely mounted to withstand the intensive centrifugal forces to which they are subjected. The blades are also exposed to high temperature variations during operations as well as axial loading from the flow of gas over the airfoil of the blades. Individual blades are periodically removed during repairs and inspection.

Some of the existing blade retention systems involve relatively complex interlocking components that are not always easy to remove during repairs or inspections. Other retention systems do not push the blade radially outward prior to operation of the gas turbine engine. These systems require that expensive machines be used once the blades are initially assembled on a rotor disc to grind the blade tips so as to obtain the desired clearance between the tips and the interior of the shroud inside which the blades will rotate. Room for improvements thus exists.

SUMMARY OF THE INVENTION

In one aspect, the present concept provides a blade retention system for use with a rotor disc of a gas turbine engine, the rotor disc having a plurality of spaced-apart and circumferentially-disposed blade retention slots extending from a first side face to a second side face of the rotor disc, the device comprising: an annular sealing plate having two opposite first and second side faces; and a plurality of spaced-apart blade retention tabs having opposite first and second ends and a radially-orientated corrugated profile, the first ends of the tabs being connected to the first side face of the annular sealing plate, each tab being inserted through a bottom portion of a respective one of the blade retention slots when the first side face of the sealing plate is positioned against one of the side faces of the rotor disc and covers an end side of the blade retention slots, the second end of each tab extending beyond the other of the side faces of the rotor disc and being bent to secure the annular sealing plate with reference to the rotor disc.

In another aspect, the present concept provides a blade retention system for securing blade roots to corresponding blade retention slots provided at a periphery of a rotor disc in a gas turbine engine, the system comprising: an annular sealing plate; and retention tabs positioned between a bottom surface of at least some of the retention slots and a bottom surface of the corresponding blade roots, each retention tab having a first end attached to the annular sealing plate, a second end opposite the first end, and an elongated section extending between the first and the second end, the elongated section of each tab having at least one radial protrusion creating a radial loading under the corresponding blade root, the tabs being longer than the blade retention slots.

In a further aspect, the present concept provides a method of retaining blades to a periphery of a rotor disc and sealing at least one side face of the rotor disc in a gas turbine engine, the method comprising: inserting roots of the blades in corresponding blade retention slots provided at the periphery of the rotor disc; inserting an elongated retention tab in a space between a bottom of the root of at least some of the blades and a bottom of the corresponding blade retention slot, each retention tab forcing the root of the corresponding blade to be urged radially outward in its blade retention slot; sealing the at least one side face using an annular sealing plate covering an end side of the blade retention slots; and securing the annular sealing plate by bending at least one end of the retention tabs that is on an opposite side face of the at least one side face of the rotor disc.

Further details of these and other aspects will be apparent from the detailed description and figures included below.

DETAILED DESCRIPTION OF THE PREFERRED EMBODIMENTS

Figure 1:
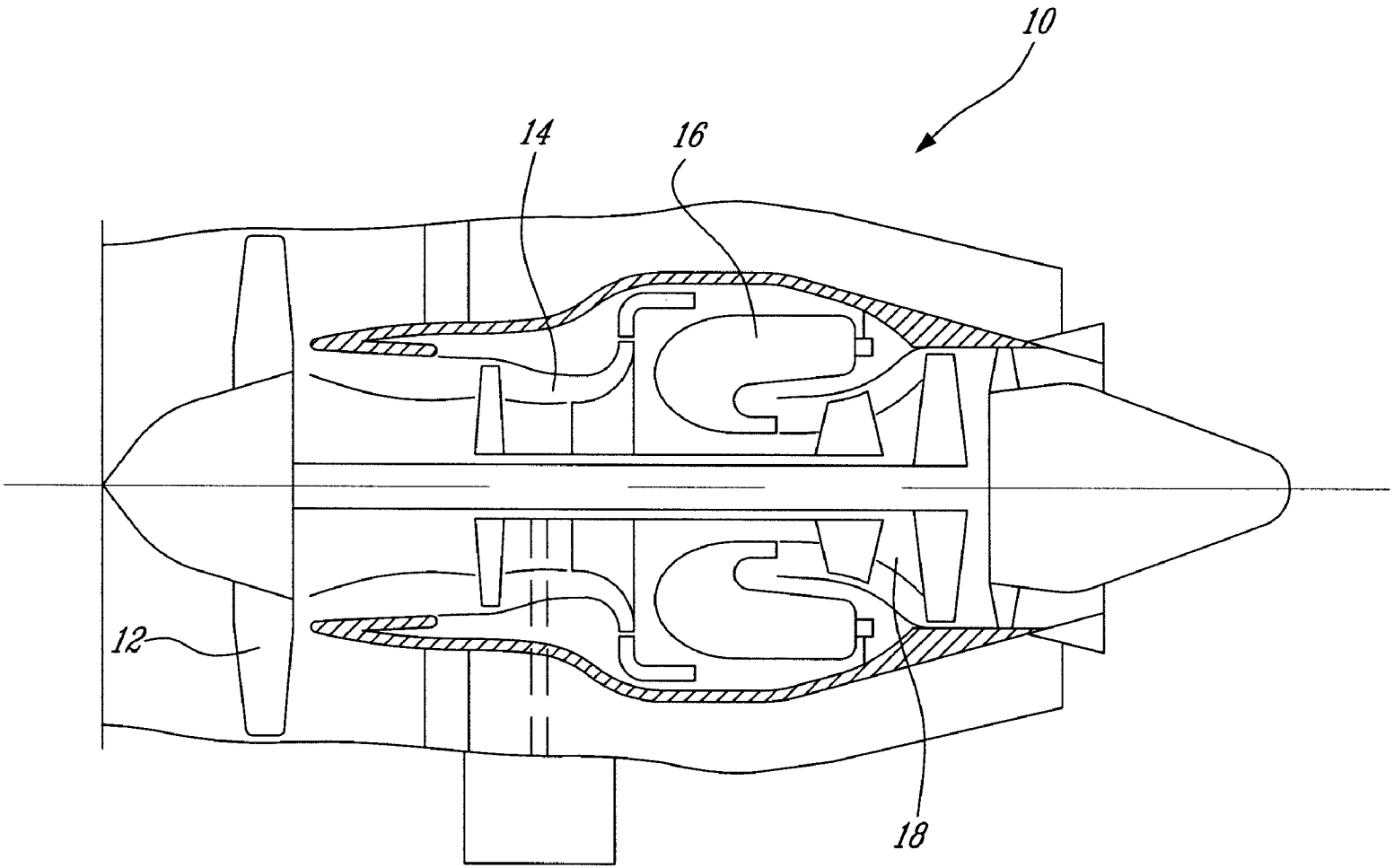
FIG. 1 schematically shows a generic gas turbine engine to illustrate an example of a general environment in which the improved blade retention system can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

This figure illustrates an example of the environment in which the improved blade retention system can be used.

Figure 2:
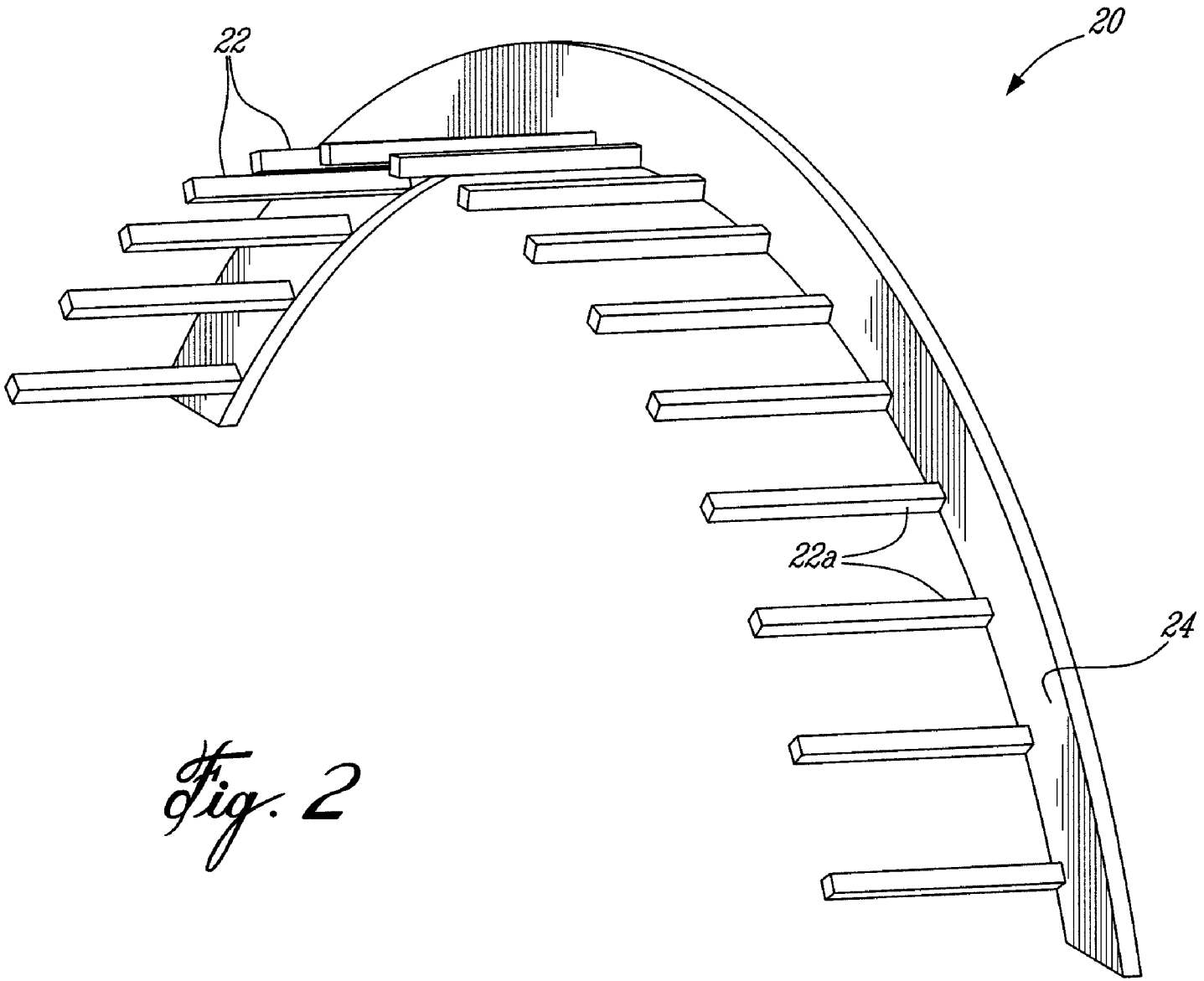
FIG. 2 is a view showing a portion of an example of an improved blade retention system with flat retention tabs.

FIG. 2 shows a first example of an improved blade retention system 20. The system 20 is illustrated partially to simplify the figure. The system 20 is otherwise constructed in an annular fashion. However, it can also be provided in two or more segments covering together the entire circumference of the rotor disc. Ideally, these segments would be identical, which simplifies the handling and manufacturing. The system 20 illustrated in FIG. 2 comprises a plurality of flat retention tabs 22. Each or some of the tabs 22 are designed to be inserted from one side face of the rotor disc into a respective blade retention slot provided at the periphery of the rotor disc. The rotor disc has a plurality of these blade retention slots extending from a first side face to a second side face of the rotor disc. The blade retention slots are equally spaced apart and may define an angle with the longitudinal axis of the rotor disc.

The system 20 comprises an annular sealing plate 24 having two opposite first and second side faces. The annular sealing plate 24 is designed to cover the side of the blade retention slots on one of the side faces of the rotor disc. In the example shown in FIG. 2, the first ends 22*a* of the tabs 22 are made integral with the first side face of the annular sealing plate 24.

Each tab 22 is configured and disposed to be inserted through a bottom portion of a respective one of the blade retention slots when the first side face of the sealing plate is positioned against one of the side faces of the rotor disc and covers an end side of the blade retention slots. The second end 22*b* of each tab 22 then extends beyond the other of the side faces of the rotor disc and is bendable to secure the annular sealing plate 24 with reference to the rotor disc.

Figure 3:
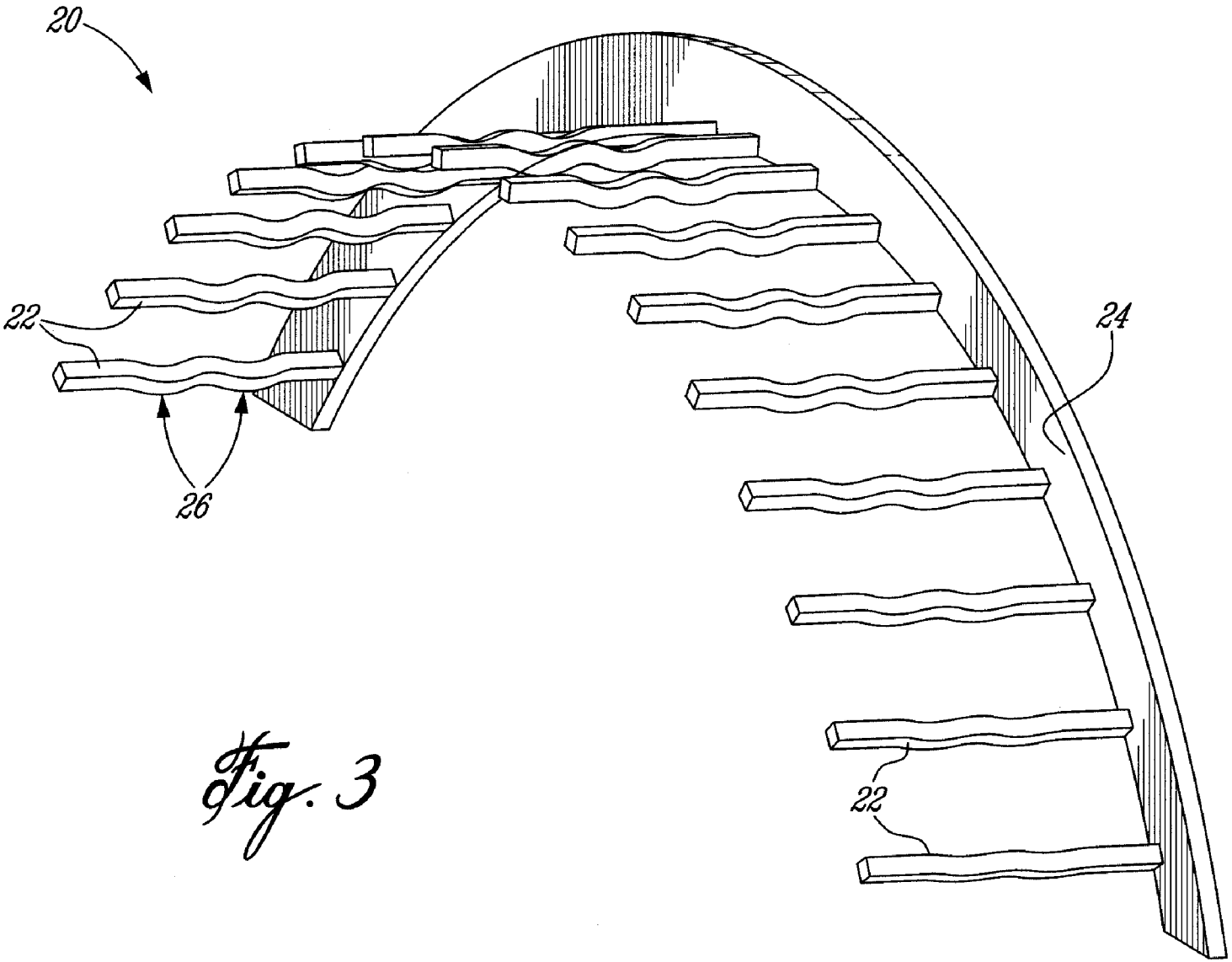
FIG. 3 is a view showing a portion of an example of a blade retention system, in which the retention tabs are corrugated.

FIG. 3 shows a portion of another example of a blade retention system 20. This system 20 differs from FIG. 2 in that the retention tabs 22 are corrugated. In the illustrated embodiment, each tab 22 has two ridges 26. Once inserted under the roots of the blades, the ridges 26 will load the blades radially-outward as if these blades would always be subjected to a centrifugal force. This simplifies the grinding of the tip of the blades after the assembly since it will not be necessary to rotate the blades at high speeds during the grinding.

Figure 4:
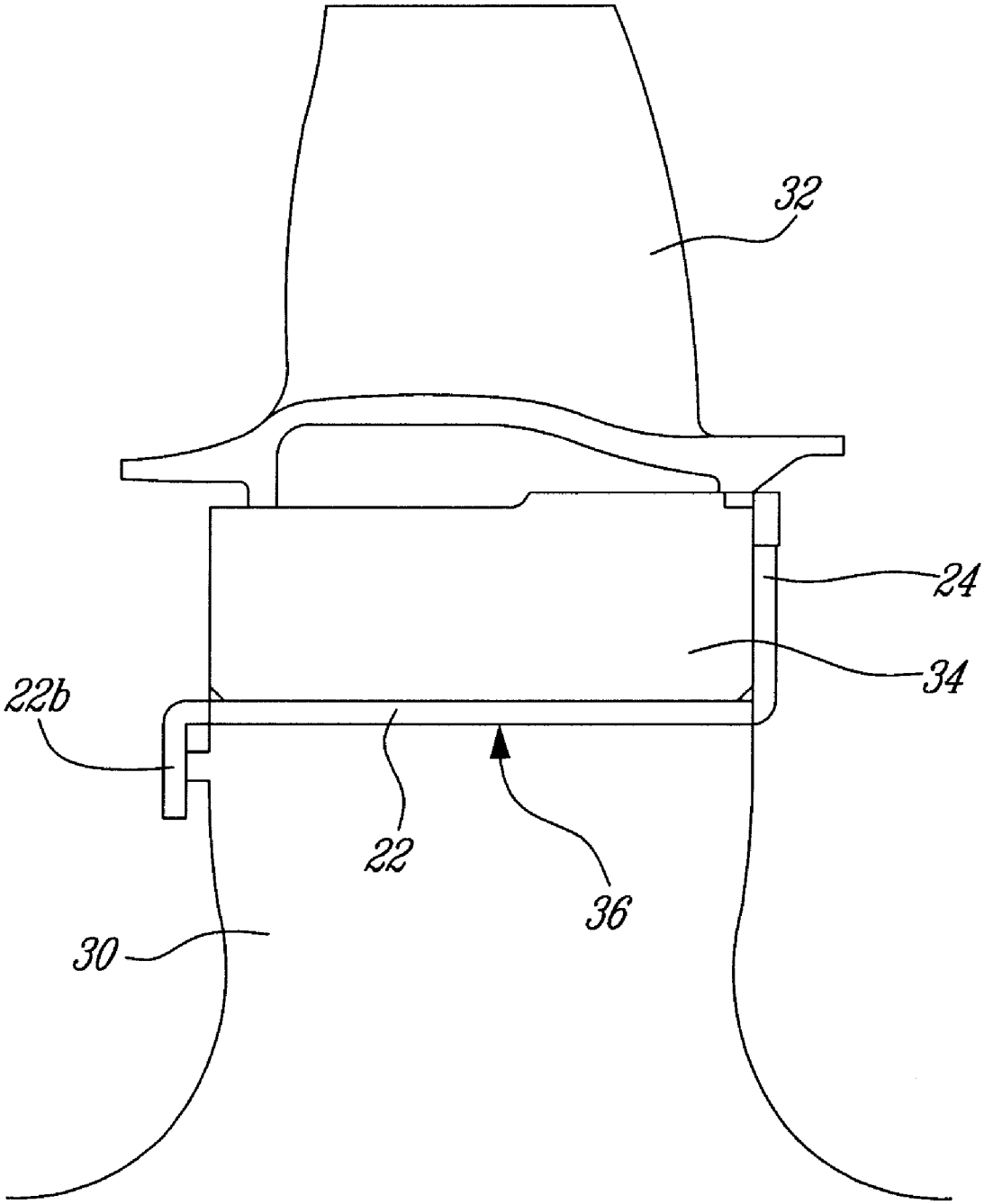
FIG. 4 is a schematic cross-sectional view of a rotor disc and a blade, showing the blade retention system of FIG. 2 with a retention tab having a free end bended over the rotor disc.

FIG. 4 is a schematic cross-sectional view of an example of a rotor disc 30 and a blade 32 in which the blade retention system 20 of FIG. 2 is provided. As can be appreciated, the tab 22 fits tightly under the root 34 of the blade 32 and the annular sealing plate 24 covers the blade retention slot 36. The second end 22*b* of the tab 22 extends though the blade retention slot 36 and is bent against the rotor disc 30, on one of the side faces thereof.

Figure 5:
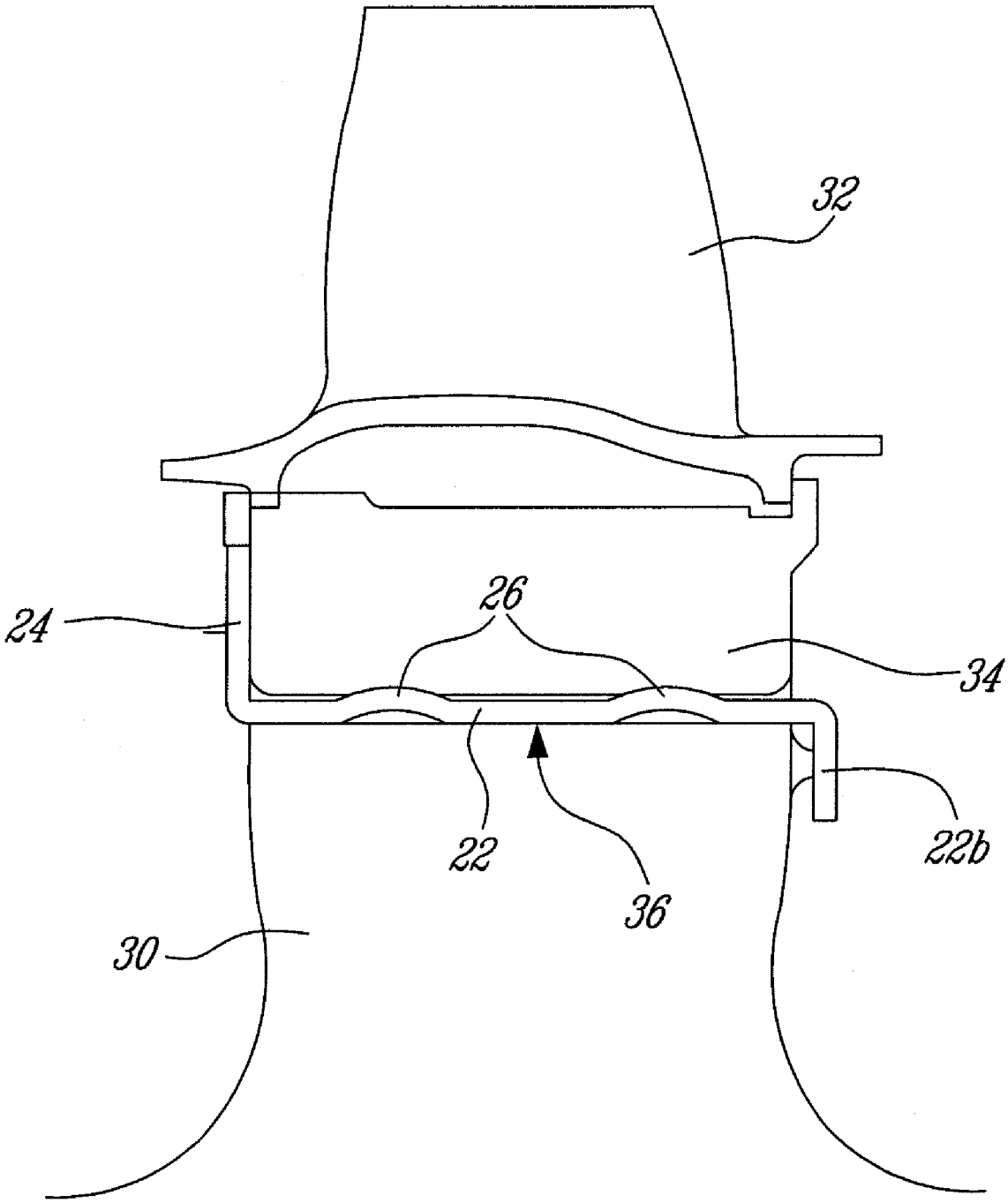
FIG. 5. is a view similar to FIG. 4, showing the blade retention system of FIG. 3, which system is provided on the opposite side of the rotor disc compared to FIG. 4.

FIG. 5 is a view similar to FIG. 4, but shows the blade retention system of FIG. 3, which system 20 has tabs 22 with ridges 26. The annular sealing plate 24 is also provided on an opposite side compared to FIG. 4.

Figure 6:
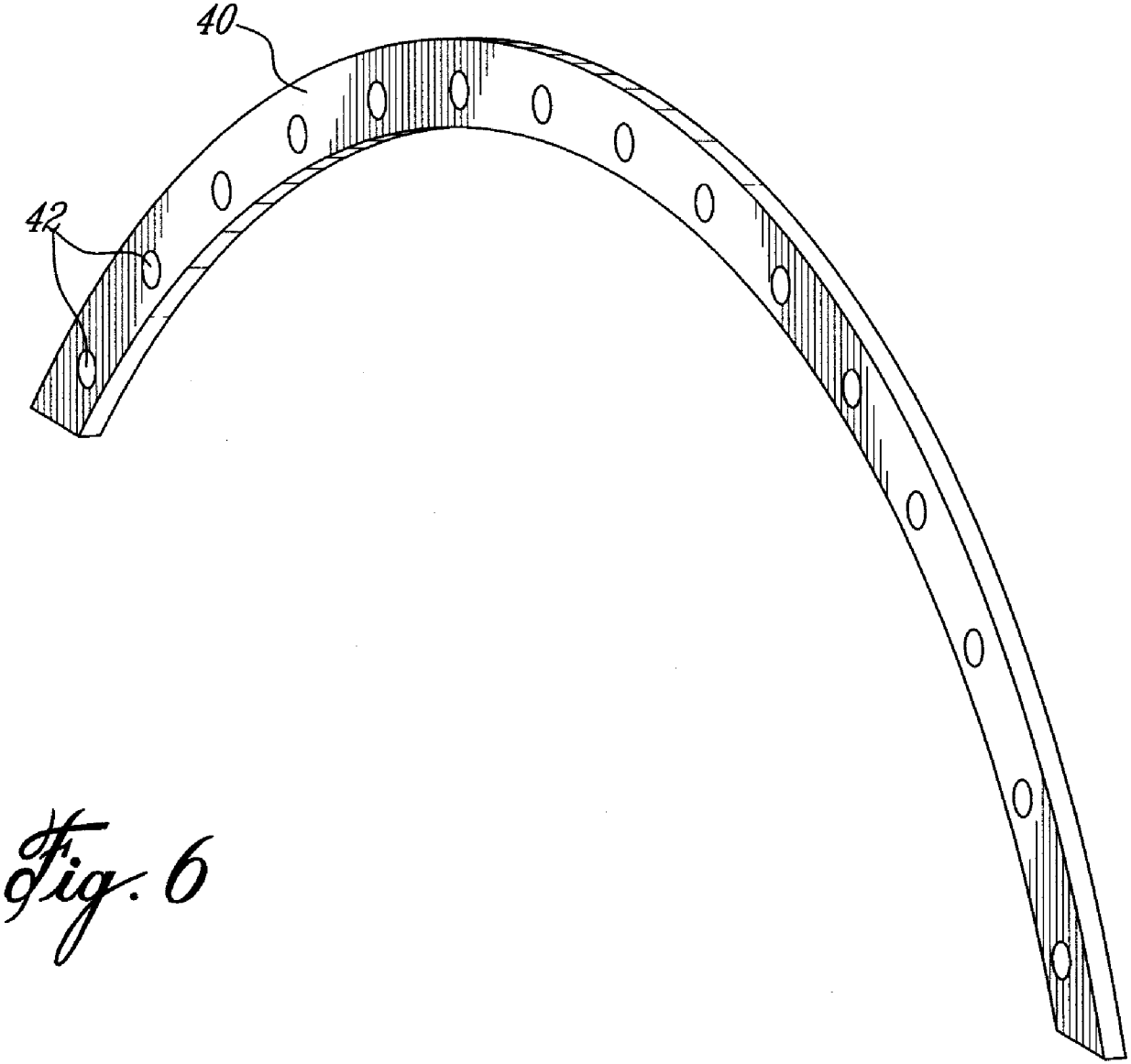
FIG. 6 is a view showing a portion of an example of an additional annular sealing plate provided with holes, which additional annular sealing plate is for use on an opposite side face of the rotor disc.
Figure 7:
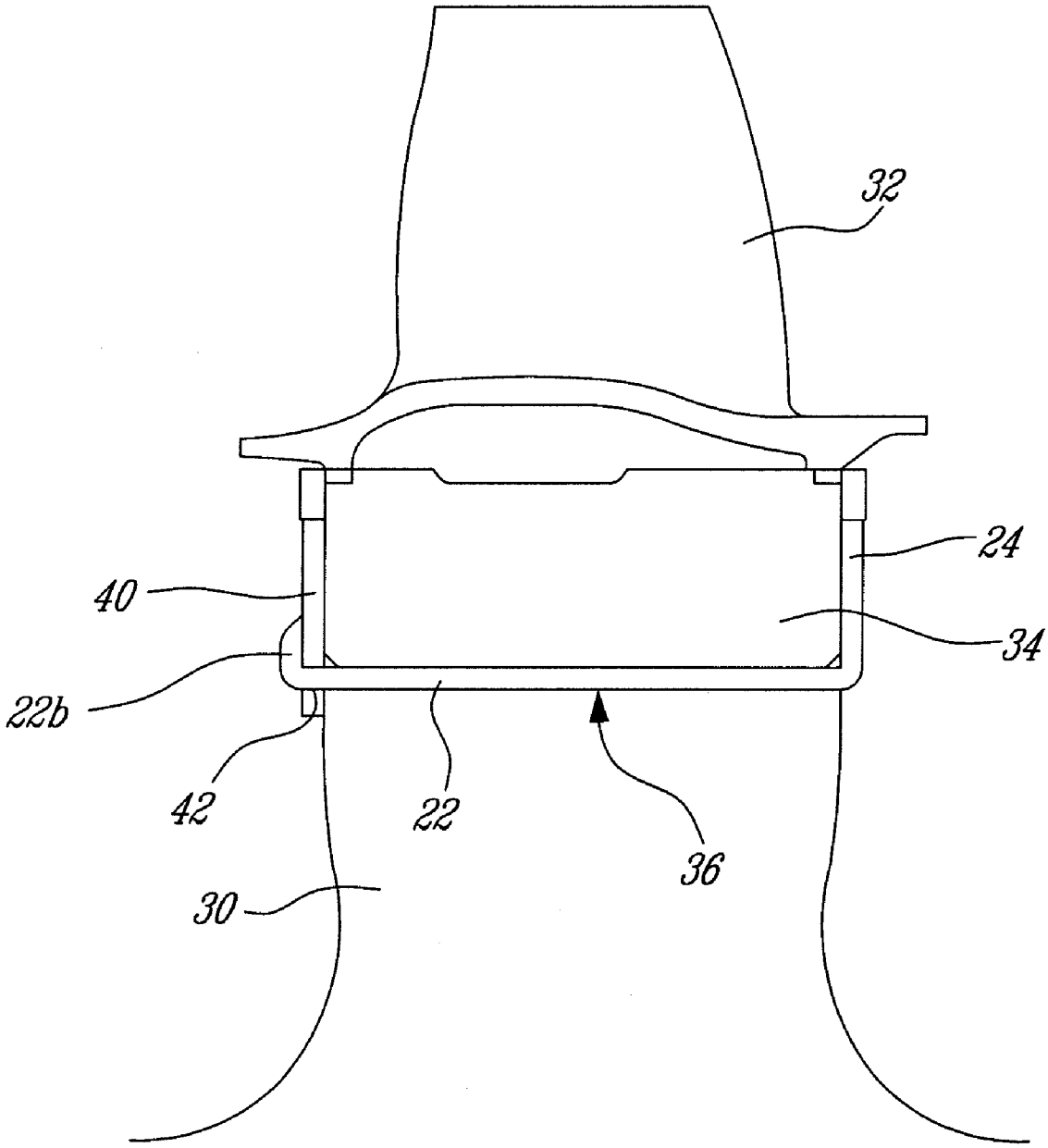
FIG. 7 is a schematic cross-sectional view of a rotor disc and a blade in which the blade retention system shown in FIG. 2 is used with the additional annular sealing plate of FIG. 6.
Figure 8:
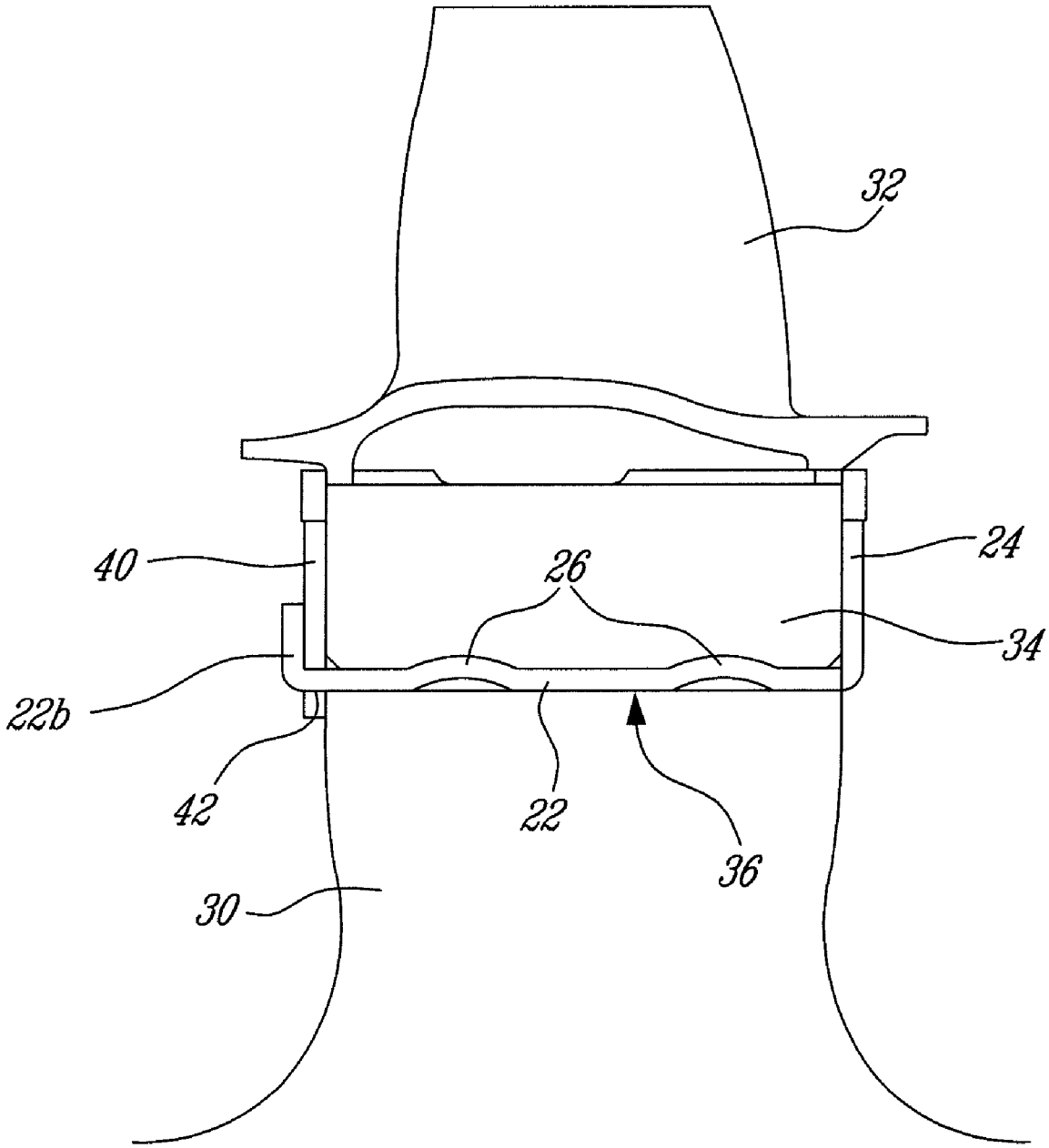
FIG. 8 is a view similar to FIG. 7, showing the blade retention system of FIG. 3 being used with the additional annular sealing plate of FIG. 6.

FIG. 6 is an isometric view showing a portion of an example of an additional annular sealing plate 40 provided with holes 42, which additional annular sealing plate 40 is used to seal an opposite side face of the rotor disc 30. FIG. 7 shows the resulting system 20. As can be seen, the additional annular sealing plate 40 is provided on an opposite side face and the second end 22*b* of the tabs 22 is bent over its back side. FIG. 8 is a view similar to FIG. 7, showing the blade retention system 20 of FIG. 3 being used with the additional annular sealing plate 40 of FIG. 6.

Figure 9:
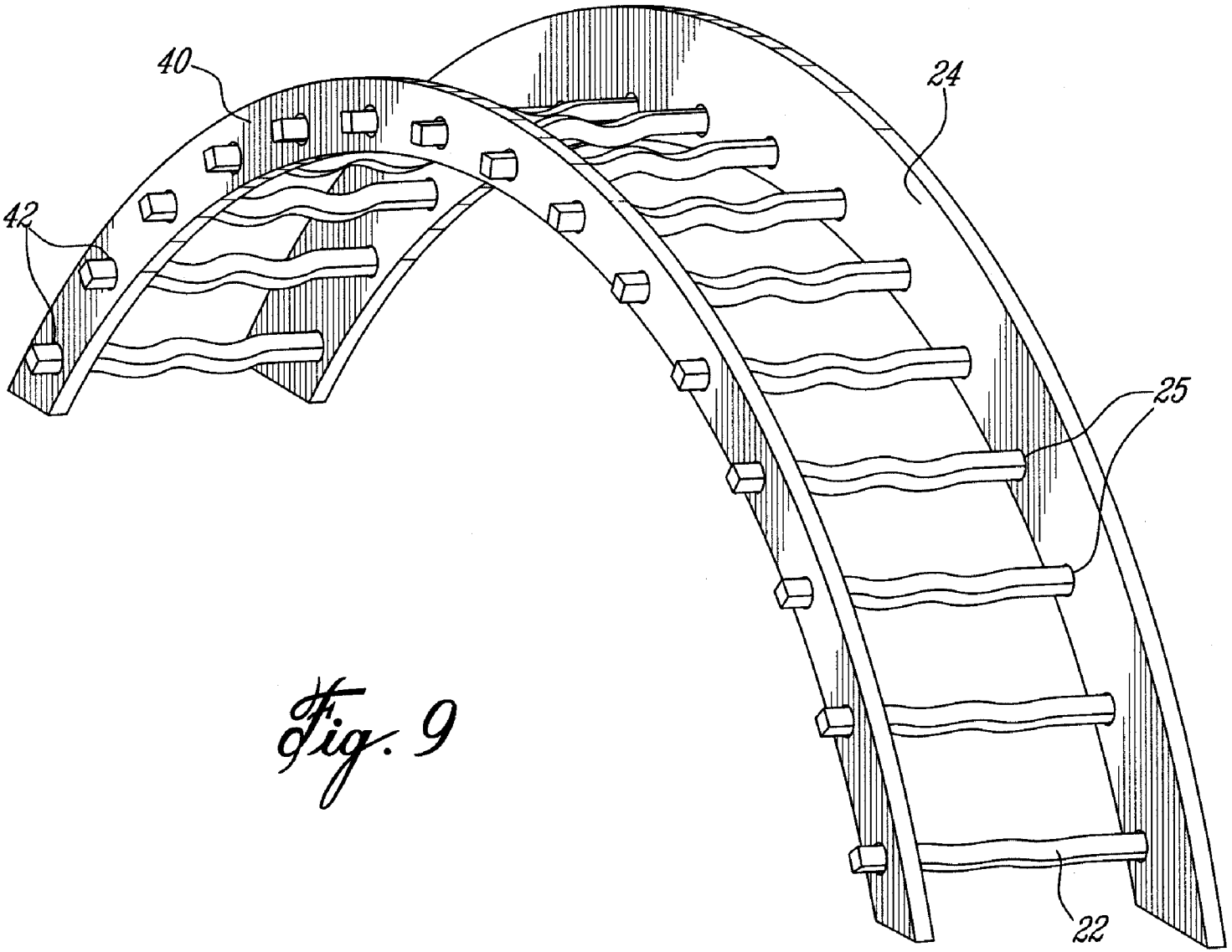
FIG. 9 is a view showing an example of an improved blade retention system in which both ends of the retention tabs are bended over two opposite annular sealing plates provided with holes.

FIG. 9 shows another example of the improved blade retention system 20. In this example, the system 20 has both ends of the retention tabs 22 being bended over two opposite annular sealing plates 24, 40 provided with holes 25, 42. The first end of the tabs 22 is then not made integral with the first annular sealing plate 24. It is rather bended on the back of the plate 24.

Figure 10:
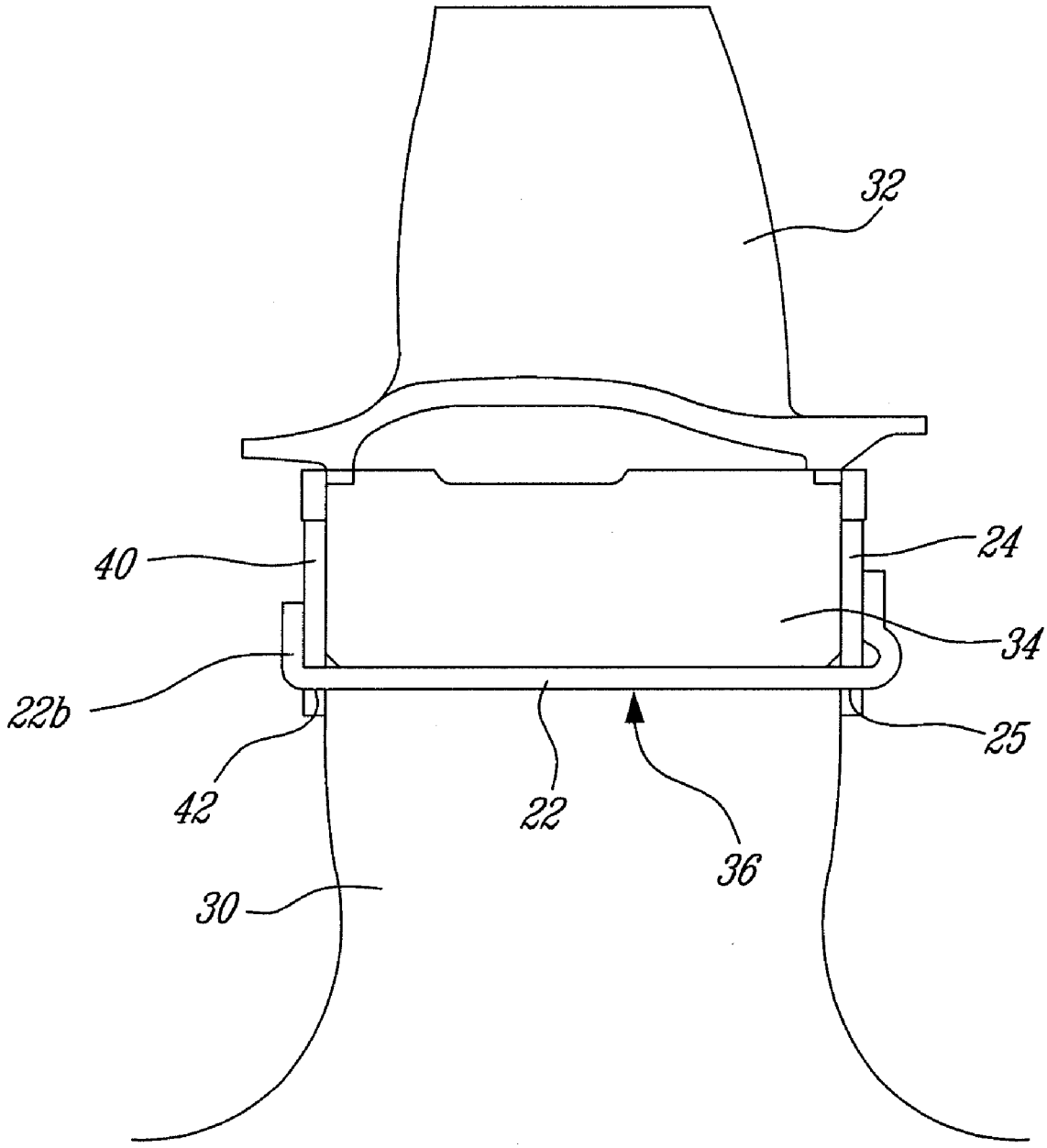
FIG. 10 is a schematic cross-sectional view of a rotor disc and a blade in which a blade retention system with two opposite annular sealing plates having holes is used, the retention tabs being flat.
Figure 11:
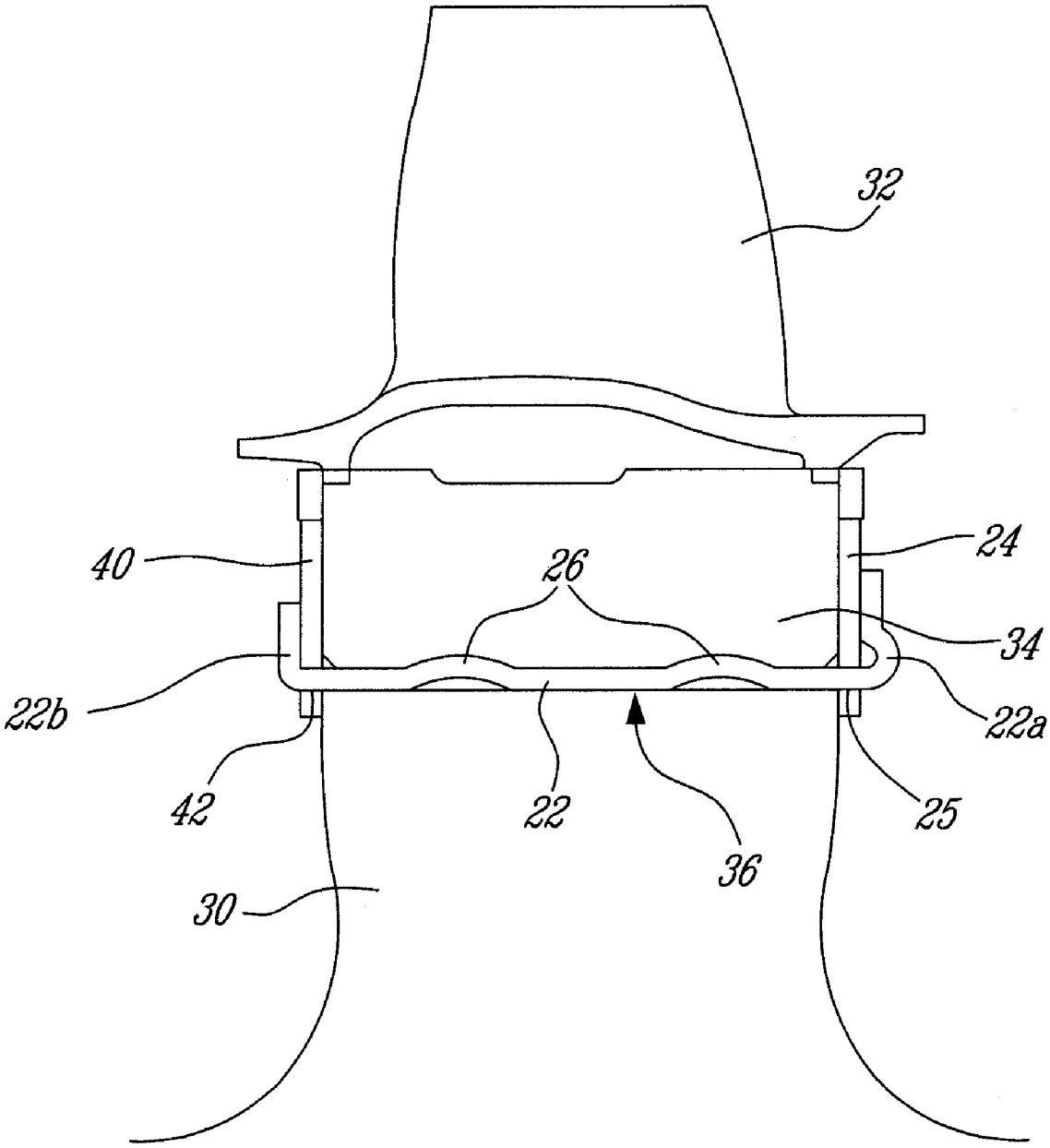
FIG. 11 is a view similar to FIG. 10, showing an improved blade retention system with corrugated retention tabs.

FIG. 10 is a schematic cross-sectional view of a rotor disc 30 and a blade 32 in which a blade retention system 20 with two opposite sealing plates 24, 40 having holes 25, 42 is used, the retention tabs 22 being flat. FIG. 11 is also a schematic cross-sectional view of a rotor disc 30 and a blade 32, but in which the improved blade retention system 20 of FIG. 9 is used.

The above description is meant to be exemplary only, and one skilled in the art will recognize that changes may be made to the embodiments described without department from the scope of the invention disclosed. For example, the exact shape of the tabs can be different from what is shown. The exact shape of the annular sealing plate and of the additional annular sealing plate can also be different from what is shown. Both annular sealing plates can be identical or be different, depending on the needs. The shape of the blade and of the rotor disc can be different from that shown in the figures. Still other modifications which fall within the scope of the present invention will be apparent to those skilled in the art, in light of a review of this disclosure, and such modifications are intended to fall within the appended claims.

What is claimed is:

1. A blade retention system for use with a rotor disc of a gas turbine engine, the rotor disc having a plurality of spaced-apart and circumferentially-disposed blade retention slots extending from a first side face to a second side face of the rotor disc, the device comprising:

an annular sealing plate having two opposite first and second side faces and a plurality of spaced-apart holes in the annular sealing plate, extending from one said side face to another said side face; and a plurality of spaced-apart blade retention tabs having opposite first and second ends and a radially-orientated corrugated profile, the first ends of the tabs being bent against the second side face of the annular sealing plate, each tab being inserted through one of said spaced-apart holes and through a bottom portion of a respective one of the blade retention slots when the first side face of the sealing plate is positioned against one of the side faces of the rotor disc and covers an end side of the blade retention slots, the second end of each tab extending beyond the other of the side faces of the rotor disc and being bent against the other of the side faces to axially retain blades with reference to the rotor disc.

2. The system as defined in claim 1, wherein the annular sealing plate is a one-piece circular item.

3. The system as defined in claim wherein the radially-oriented corrugated profile includes at least two ridges.

4. The system as defined in claim 1, wherein the first end of each retention tab is connected to the annular sealing plate by inserting the first end through a corresponding hole made through the annular sealing plate, and bending the first end.

5. A blade retention system for securing blade roots to corresponding blade retention slots provided at a periphery of a rotor disc in a gas turbine engine, the system comprising:

an annular sealing plate;

retention tabs positioned between a bottom surface of at least some of the retention slots and a bottom surface of the corresponding blade roots, each retention tab having a first end attached to the annular sealing plate, a second end opposite the first end, and an elongated section extending between the first and the second end, the elongated section of each tab having at least one radial protrusion creating a radial loading under the corresponding blade root, the tabs being longer than the blade retention slots; and an additional annular scaling plate to be positioned against the other side face of the rotor disc, the additional sealing plate covering another end side of the blade retention slots and comprising a plurality of holes through which the second end of the corresponding retention tabs is inserted before being bent.

6. The system as defined in claim 5, wherein the annular sealing plate is divided in at least two segments.

7. The system as defined in claim 6, wherein the segments are identical to one another.

8. The system as defined in claim 5, wherein the elongated section includes two of said radial protrusion.

9. The system as defined in claim 5, wherein the first ends of the retention tabs are made integral with the annular sealing plate.

10. The system as defined in claim 5, wherein the first end of each retention tab is connected to the annular sealing plate by inserting the first end through a corresponding hole made through the annular sealing plate, and bending the first end.

11. A method of retaining blades to a periphery of a rotor disc and sealing at least one side face of the rotor disc in a gas turbine engine, the method comprising:

inserting roots of the blades in corresponding blade retention slots provided at the periphery of the rotor disc;

inserting an elongated retention tab in a space between a bottom of the root of at least some of the blades and a bottom of the corresponding blade retention slot with at least one said elongated retention tab extending out of the blade retention slot and having opposite ends extending beyond the side faces of the rotor disc, each retention tab forcing the root of the corresponding blade to be urged radially outward in its blade retention slot;

sealing a plurality of the blade retention slots of the at least one side face concurrently using an annular sealing plate covering an end side of the blade retention slots, the annular sealing plate having spaced-apart holes through which a first end of the retention tabs passes when the sealing plate is against the rotor disc; and clamping the annular sealing plate by bending radially inward a second end of the retention tabs that is on the opposite side face of the at least one side face of the rotor disc, and bending the first end against the annular sealing plate.

12. The method as defined in claim 11, wherein the ends of the retention tabs are bent simultaneously.

13. The method as defined in claim 11, wherein all blades of the rotor disc have a corresponding retention tab.

14. The method as defined in claim 11, wherein only some of the blades have a corresponding retention tab, adjacent retention tabs being evenly spaced from one another.

* * * * *

UNITED STATES PATENT AND TRADEMARK OFFICE

CERTIFICATE OF CORRECTION

PATENT NO. : 7,806,662 B2
APPLICATION NO. : 11/734436
DATED : October 5, 2010
INVENTOR(S) : Eugene Gekht and Franco Di Paola It is certified that error appears in the above-identified patent and that said Letters Patent is hereby corrected as shown below:

claim 5, column 5, line 4, delete "scaling" insert --sealing--

Signed and Sealed this

Fourteenth Day of December, 2010

David J. Kappos

David J. Kappos
*Director of the United States Patent and Trademark Office*